US007900794B2

(12) United States Patent
Dhellemmes et al.

(10) Patent No.: US 7,900,794 B2
(45) Date of Patent: Mar. 8, 2011

(54) SEALED, THERMALLY INSULATED TANK WITH COMPRESSION-RESISTANT NON-CONDUCTING ELEMENTS

(75) Inventors: Jacques Dhellemmes, Versailles (FR); Pierre Michalski, Le Havre (FR); Vincent Fargant, Rochefort en Yvelines (FR)

(73) Assignee: Gaztransport et Technigaz, Saint-Remy-les-Chevreuse (FR)

( * ) Notice: Subject to any disclaimer, the term of this patent is extended or adjusted under 35 U.S.C. 154(b) by 0 days.

(21) Appl. No.: 12/844,352

(22) Filed: Jul. 27, 2010

(65) Prior Publication Data

US 2010/0288778 A1 Nov. 18, 2010

Related U.S. Application Data

(63) Continuation of application No. 11/265,079, filed on Nov. 3, 2005.

(30) Foreign Application Priority Data

Nov. 10, 2004 (FR) ..... 04 11968

(51) Int. Cl.
*F17C 1/00* (2006.01)

(52) U.S. Cl. ..... 220/560.05; 114/74 A; 220/592.26; 220/651; 220/653; 220/901

(58) Field of Classification Search ..... 114/74 A; 220/560.05, 592.26, 651, 653, 901
See application file for complete search history.

(56) References Cited

U.S. PATENT DOCUMENTS

| | | | |
|---|---|---|---|
| 3,970,210 | A | 7/1976 | Katsuta |
| 5,501,359 | A | 3/1996 | Chauvin et al. |

FOREIGN PATENT DOCUMENTS

| | | |
|---|---|---|
| FR | 2 527 544 | 6/1982 |
| FR | 2 629 897 | 4/1988 |
| FR | 2 798 902 | 3/2001 |
| GB | 1112136 | 9/1966 |
| GB | 1 478 969 | 7/1973 |

*Primary Examiner* — Anthony Stashick
*Assistant Examiner* — Elizabeth Volz
(74) *Attorney, Agent, or Firm* — Young & Thompson

(57) ABSTRACT

Sealed, thermally insulated tank has tank walls fixed to the load-bearing structure (1) of a floating structure, the tank walls having, in succession, in the direction of the thickness from the inside to the outside of the tank, a primary sealing barrier (8), a primary insulating barrier (6), a secondary sealing barrier (5) and a secondary insulating barrier (2), at least one of the insulating barriers includes juxtaposed non-conducting elements, each non-conducting element including a thermal insulation liner (63) and load-bearing elements that rise through the thickness of the thermal insulation liner in order to take up the compression forces, characterized in that the load-bearing elements of a non-conducting element include pillars (65) of small transverse section as compared to the dimensions of the non-conducting element in a plane parallel to the tank wall.

19 Claims, 12 Drawing Sheets

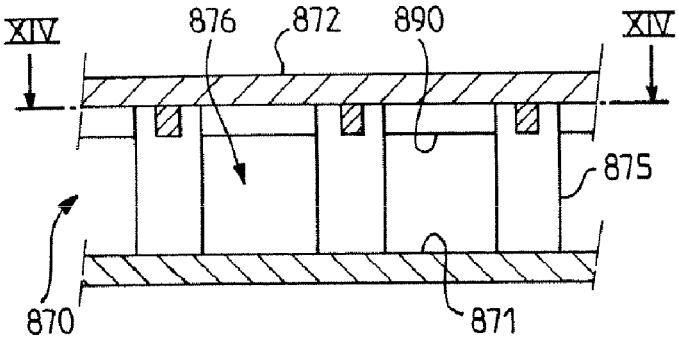
FIG.13
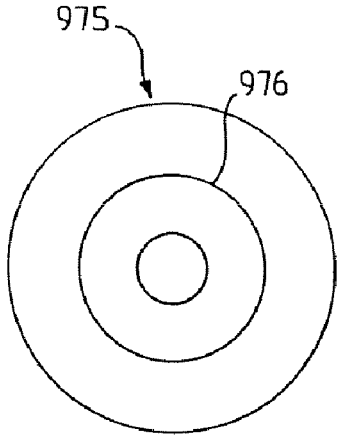
FIG.15
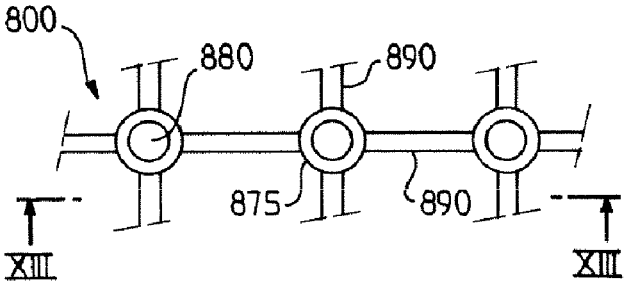
FIG.14
FIG.17
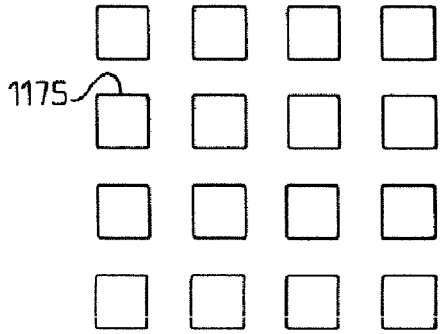
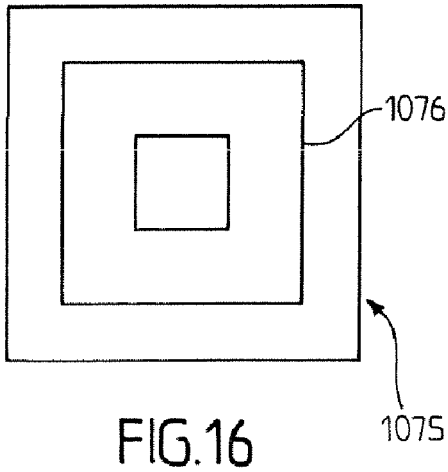
FIG.16
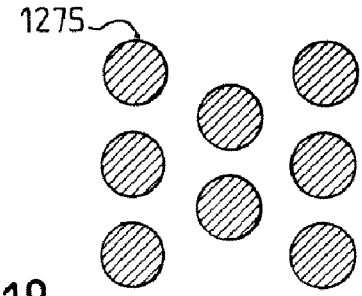
FIG.18

SEALED, THERMALLY INSULATED TANK WITH COMPRESSION-RESISTANT NON-CONDUCTING ELEMENTS

CROSS REFERENCE TO RELATED APPLICATIONS

This application is a continuation of co-pending application Ser. No. 11/265,079 filed on Nov. 3, 2005, which claims priority to French Application No. 04 11968 filed on Nov. 10, 2004. The entire contents of each of the above-identified applications are hereby incorporated by reference.

BACKGROUND OF THE INVENTION

The present invention relates to the production of sealed, thermally insulated tanks consisting of tank walls fixed to the load-bearing structure of a floating structure suitable for the production, storage, loading, ocean carriage and/or unloading of cold liquids such as liquefied gases, particularly those with a high methane content. The present invention also relates to a methane carrier provided with a tank of this type.

DESCRIPTION OF THE RELATED ART

Ocean carriage of liquefied gas at very low temperature involves an evaporation rate per day's sailing that it would be advantageous to minimize, which means that the thermal insulation of the relevant tanks should be improved.

A sealed, thermally insulated tank consisting of tank walls fixed to the load-bearing structure of a ship has already been proposed, said tank walls having, in succession, in the direction of the thickness from the inside to the outside of said tank, a primary sealing barrier, a primary insulating barrier, a secondary sealing barrier and a secondary insulating barrier, at least one of said insulating barriers consisting essentially of juxtaposed non-conducting elements, each non-conducting element including a thermal insulation liner arranged in the form of a layer parallel to said tank wall, and load-bearing elements that rise through the thickness of said thermal insulation liner in order to take up the compression forces.

For example, in FR-A-2 527 544 these insulating barriers consist of closed parallelepipedal caissons made from plywood and filled with perlite. On the inside, the caisson includes parallel load-bearing spacers interposed between a cover panel and a base panel in order to withstand the hydrostatic pressure exerted by the liquid contained in the tank. Non-load-bearing spacers made from plastic foam are placed between the load-bearing spacers in order to maintain their relative positioning. Manufacture of a caisson of this type, including the assembly of the outer walls made from plywood sections and the fitting of the spacers, requires a number of assembly operations, particularly stapling. Furthermore, the use of a powder such as perlite complicates the manufacture of the caissons because the powder produces dust. Thus, it is necessary to use high-quality and therefore expensive plywood so that the caisson is well sealed against dust, i.e. knot-free plywood. Furthermore, it is necessary to tamp down the powder with a specific pressure in the caisson, and it is necessary to circulate nitrogen inside each caisson in order to evacuate all the air present, for safety reasons. All these operations complicate manufacture and increase the cost of the caissons. Moreover, if the thickness of the insulating caissons is increased with an insulating barrier, the risk of the walls of the caissons and the load-bearing spacers buckling increases considerably. If it is desired to increase the anti-buckling strength of the caissons and of their internal load-bearing spacers, the cross section of said spacers has to be increased, which increases the thermal bridges established between the liquefied gas and the load-bearing structure of the ship by the same amount. Furthermore, if the thickness of the caissons is increased it is observed that, inside the caissons, gas convection currents arise that are highly detrimental to good thermal insulation.

FR-A-2 798 902 describes other thermally insulated caissons designed for use in such a tank. Their method of manufacture consists in alternately stacking a plurality of low-density foam layers and a plurality of plywood panels, placing adhesive between each foam layer and each panel until the height of said stack corresponds to the length of said caissons, in cutting the above-mentioned stack into sections in the direction of the height, at regular intervals corresponding to the thickness of a caisson, and in adhesively bonding a base panel and a top panel made from plywood on either side of each stack section thus cut, said panels extending perpendicularly to said cut panels, which serve as spacers. Although the result of this is a good compromise in terms of anti-buckling strength and thermal insulation, it has to be admitted that this manufacturing process also requires numerous assembly stages.

SUMMARY OF THE INVENTION

An object of the invention is to propose a tank of this type while also improving at least one of the following characteristics without detriment to others of these characteristics: the tank's cost price, the ability of the walls to withstand pressure and the thermal insulation of the walls. A further object of the invention is to propose a tank of this type in which the non-conducting elements are easily adaptable in terms of their dimensions, without compromising the ability of the walls to withstand pressure and the thermal insulation of the walls.

To that end, a subject of the invention is a sealed, thermally insulated tank including at least one tank wall fixed to the hull of a floating structure, said tank wall having, in succession, in the direction of the thickness from the inside to the outside of said tank, a primary sealing barrier, a primary insulating barrier, a secondary sealing barrier and a secondary insulating barrier, at least one of said insulating barriers consisting essentially of juxtaposed non-conducting elements, each non-conducting element including a thermal insulation liner arranged in the form of a layer parallel to said tank wall, and load-bearing elements that rise through the thickness of said thermal insulation liner in order to take up the compression forces, characterized in that said load-bearing elements of a non-conducting element include pillars of small transverse section as compared with the dimensions of the non-conducting element in a plane parallel to said tank wall.

Small-cross section pillars of this type have the advantage that they can be distributed in the non-conducting element as a function of local requirements. By adapting the number and the distribution of the load-bearing pillars, the non-conducting element's compression strength can, in particular, be made more uniform than with prior-art spacers. It is also possible to prevent localized depression or pinching of a cover panel. Advantageously, said pillars are regularly distributed over the entire surface of the non-conducting element seen in a plane parallel to the tank wall. A further advantage of the non-conducting element with small-cross section pillars is that it allows the manufacture of a non-conducting element of any desired dimensions without loss of compression strength, at least insofar as these dimensions remain greater than or equal to the spacing between the pillars. A non-conducting element of small surface area may, in particular, be obtained by cutting an element of larger surface area.

According to a particular embodiment, said pillars are identically spaced apart in the length direction and in the width direction of the non-conducting element.

Pillars of this type may have a hollow or solid cross section, for which a number of shapes are possible. Preferably, said pillars have a closed hollow transverse section. Such hollow pillars with a closed transverse section, in particular tubes with a circular cross section, make it possible to obtain very good anti-buckling resistance while at the same time minimizing the effective thermal conduction cross section.

Advantageously, said pillars are produced from plastic or a composite.

Preferably, said insulation liner of the non-conducting element includes a block of synthetic foam.

According to one embodiment, said pillars are inserted in holes machined in said block of synthetic foam.

According to a further embodiment, said block of synthetic foam is obtained by pouring between said pillars so as to embed at least one height portion of said pillars, for example half or all their height, in said block of synthetic foam.

Advantageously, said non-conducting element includes a planar positioning element arranged parallel to said tank wall in the thickness of the insulation liner and having openings traversed by said pillars in order to define their mutual positioning.

Preferably, said non-conducting element includes at least one panel extending parallel to said tank wall on a side of said non-conducting element. In other words, in such a case, the non-conducting element comprises a base panel or a cover panel. By convention, "cover" is the name given to a panel on that side of the non-conducting element that faces toward the inside of the tank and "base" is the name given to a panel on the side of the non-conducting element that faces toward the load-bearing structure. The non-conducting element may also include both a base panel and a cover panel. Any fixing means may be used for fixing a panel of this type to the non-conducting element.

The non-conducting elements may be open or closed. Advantageously, the presence of a cover panel provides uniform support for the adjacent sealing barrier. However, a panel of this type is not mandatory because sufficient support of this type may also be obtained from the pillars alone. Advantageously, the presence of a base panel provides well distributed transmission of compression forces from the primary insulating barrier toward the secondary insulating barrier or from the secondary insulating barrier toward the hull. However, a panel of this type is not mandatory because this transmission may also be sufficiently guaranteed by the pillars alone. Panels of this type may be formed in several ways. One possibility is to form a load-bearing structure incorporating, as a single piece, a panel with the pillars. A further possibility is to fix a separate panel on a side of the non-conducting element.

Advantageously, the inner face of a said panel has recesses arranged in such a manner as to interact by flush-fitting with said pillars. This results in a particularly robust link. In such a case, the panel may have a thermal expansion coefficient that is different from that of said pillars so as to give rise to gripping between said panel and said pillars flush-fitted in the latter when the tank is cooled.

According to a particular embodiment, said non-conducting element has the form of a closed box with a base panel, a cover panel and peripheral walls extending between said panels along the edges of the latter. A design of this type allows the fitting of an insulation liner in the form of granular material. However, depending on the construction of the insulation liner, it is possible, also, to use non-conducting elements that do not have peripheral walls.

According to a further particular embodiment, said load-bearing elements of a non-conducting element are produced in the form of at least one load-bearing structure formed as a single piece including, on each occasion, linking means that rigidly link said load-bearing elements together and at least one height portion of said pillars.

A load-bearing structure of this type formed as a single piece combines very advantageous mechanical properties both in terms of stiffness and in terms of anti-buckling resistance in the direction of the thickness of the hollow elements, of ease of forming, of thermal insulation and of cost price. Indeed, for a given geometry of the pillars, their anti-buckling resistance is increased by the rigid integral links as compared to separate pillars. Furthermore, manufacture of the links between the pillars and pillars, i.e. at least one portion of their height, in the form of a single piece makes it possible to dispense with certain assembly operations, makes it possible to obtain a relatively rigid load-bearing structure without excessively increasing the cross section of the pillars and/or their thickness, and thus the thermal bridges, and simplifies fitting of the thermal insulation liner in the non-conducting element.

According to a further embodiment of the linking means, said linking means include arms extending between said pillars. Advantageously, said arms extend parallel to said tank wall along at least one side of said insulation liner. Positioned in this way, the arms offer a supplementary surface, in addition to that of the pillars, for the fixing of a possible base panel and/or cover panel formed independently of the load-bearing structure.

According to a preferred embodiment of the linking means, said linking means of a load-bearing structure include a panel extending parallel to said tank wall on a side of said non-conducting element, said pillars projecting from an inner face of said panel.

According to one embodiment of the non-conducting element, it has two load-bearing structures arranged in such a manner that their respective panels have said inner faces turned toward one another, the pillars projecting from said inner faces being assembled in pairs in the region of their ends located opposite said panels in order to form, on each occasion, a pillar of said non-conducting element. In other words, in such a case, the pillars of each of the two load-bearing structures are placed end to end in order to form, on each occasion, a pillar having two parts extending, respectively, through a portion of the thickness of the non-conducting element. In particular, it is possible to use two completely symmetrical load-bearing structures.

Advantageously, an insulation piece having a thermal conductivity that is lower than that of said pillars is interposed, on each occasion, between the two assembled pillars. This makes it possible to improve the thermal insulation obtained by means of the non-conducting element.

The two load-bearing structures may be assembled by any means. Preferably, the pillars of the two load-bearing structures are assembled in pairs, on each occasion, by means of a linking piece having a thermal expansion coefficient that is different from that of said pillars so as to give rise to gripping between said linking piece and said pillars when the tank is cooled. As a variant embodiment, or in combination, the linking piece may also be flush fitted, adhesively bonded, snap-fitted, etc.

Preferably, the load-bearing structure or structures of a non-conducting element is (or are) manufactured using a process of molding, extrusion, pultrusion, thermoforming, blow-molding, injection-molding or rotational molding. The load-bearing structures may be manufactured from any material suitable for the above-mentioned processes, particularly plastics such as PC, PBT, PA, PVC, PE, PS, PU and other resins. Advantageously, the load-bearing structures are produced from a composite material. The use of this type of materials brings together the conditions necessary for obtaining load-bearing elements with a thinner wall thickness than with plywood, while at the same time offering better or equivalent thermal conductivity and a lower expansion coefficient. For example, said load-bearing structures may be produced from a polymer-resin-based composite material, for example polyester resin or another resin. Within the meaning of the invention, polymer-resin-based composite materials include polymers or mixtures of polymers with all kinds of fillers, additives, reinforcements or fibers, for example glass fibers or other fibers, providing sufficient rupture strength and rigidity and other properties. Additives may also be employed to reduce the material's density and/or improve its thermal properties, particularly reducing its thermal conductivity and/or its expansion coefficient. Use may also be made of a composite that includes a high proportional of sawdust with a synthetic binder. In certain embodiments, the load-bearing structure may also be made from laminated wood or plywood molded by hot compression.

According to a particular embodiment, said at least one insulating barrier consisting of said non-conducting elements is covered, on each occasion, by one of said sealed barriers that is formed from thin metal plate strakes with a low expansion coefficient, the edges of which are raised toward the outside of said non-conducting elements, said non-conducting elements having cover panels carrying parallel grooves spaced by the width of a plate strake in which weld supports are slideably retained, each weld support having a continuous wing projecting from the outer face of the cover panel and on whose two faces the raised edges of two adjacent plate strakes are welded in a leaktight manner. The sliding weld supports form gliding joints allowing different barriers to move relative to one another through the effect of differences in thermal contraction and movements of the liquid contained in the tank.

Advantageously, secondary retention members integral with the load-bearing structure of the ship fix the non-conducting elements forming the secondary insulating barrier against said load-bearing structure, and primary retention members linked to said weld supports of the secondary sealing barrier retain said primary insulating barrier against the secondary sealing barrier, said weld supports retaining said secondary sealing barrier against the cover panels of the non-conducting elements of the secondary insulating barrier. Thus, the primary insulating barrier is anchored on the secondary insulating barrier, with no effect on the continuity of the secondary sealing barrier interposed between them.

According to a preferred embodiment, said thermal insulation liner includes reinforced or unreinforced, rigid or flexible foam of low density, i.e. under 60 kg/m$^3$, for example around 40 to 50 kg/m$^3$, which has very good thermal properties. It is also possible to use a material of nanoscale porosity of the aerogel type. A material of the aerogel type is a low-density solid material with an extremely fine and highly porous structure, possibly with a porosity up to 99%. The pore size of these materials is typically in the range between 10 and 20 nanometers. The nanoscale structure of these materials greatly limits the mean free path of the gas molecules, and therefore also convective heat and mass transfer. Aerogels are thus very good thermal insulators, with a thermal conductivity, for example, below $20\times10^{-3}$ W·m$^{-1}$·K$^{-1}$, preferably less than $16\times10^{-3}$ W·m$^{-1}$·K$^{-1}$. They typically have a thermal conductivity 2 to 4 times as low as that of other, conventional insulators, such as foams. Aerogels may be in different forms, for example in the form of powder, beads, nonwoven fibers, fabric, etc. The very good insulating properties of these materials make it possible to reduce the thickness of the insulating barriers in which they are used, which increases the useful volume of the tank.

The invention also provides a floating structure, in particular a methane carrier, characterized in that it comprises a sealed, thermally insulated tank according to the subject of the above invention. A tank of this type may, in particular, be employed in an FPSO (floating, production, storage and offloading) facility, used to store the liquefied gas with a view to exporting it from the production site, or an FSRU (floating storage and regasification unit) used to unload a methane carrier with a view to supplying a gas transportation system.

BRIEF DESCRIPTION OF THE DRAWINGS

The invention will be better understood and further objects, details, characteristics and advantages thereof will become more clearly apparent in the course of the following description of a particular embodiment of the invention that is given solely by way of non-limiting illustrative example with reference to the appended drawings, in which:

FIG. 13 is a partial, sectional view of a non-conducting element according to a further embodiment of the invention;

FIG. 14 is a plan view of the load-bearing structure of the non-conducting element of FIG. 13;

FIGS. 15 to 18 show further embodiments of load-bearing elements in the form of pillars, seen in transverse section;

DESCRIPTION OF THE PREFERRED EMBODIMENTS

A description will be given below of several embodiments of a sealed, thermally insulated tank incorporated in and anchored to the double hull of a structure of the FPSO or FSRU type or of a methane-type carrier. The general structure of such a tank is well known per se and has a polyhedral form. Therefore, a description will be given only of a wall zone of the tank, it being understood that all the walls of the tank have a similar structure.

Figure 1:
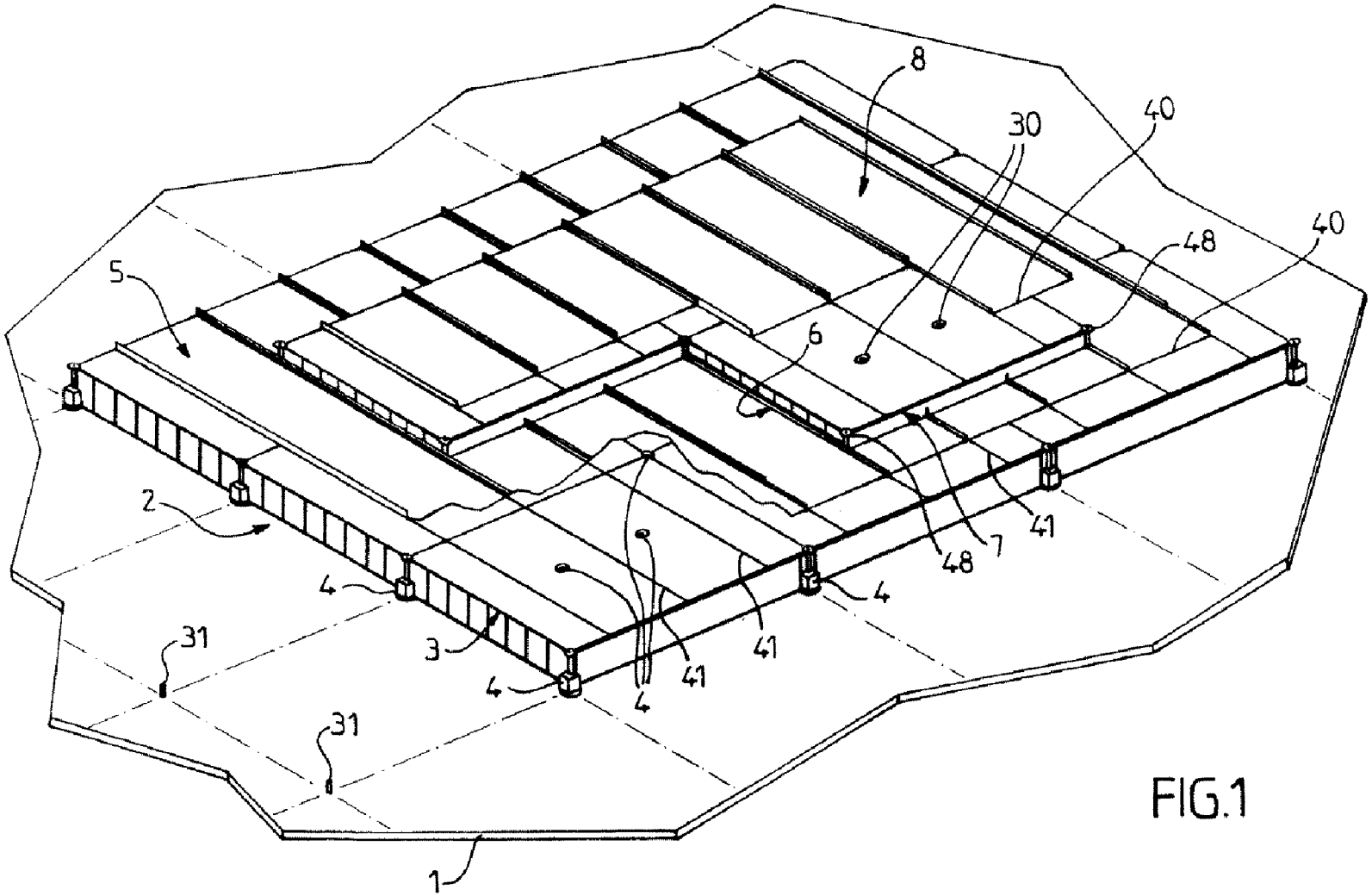
FIG. 1 is a stripped-back perspective view of a tank wall according to a general embodiment that is useful for understanding the invention.
Figure 3:
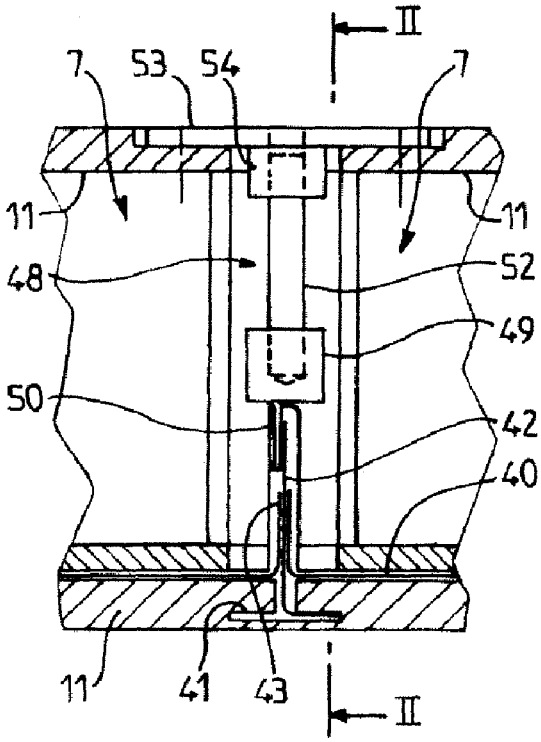
FIGS. 2 and 3 show a primary retention member of the tank wall of FIG. 1 seen in two perpendicular directions.
Figure 2:
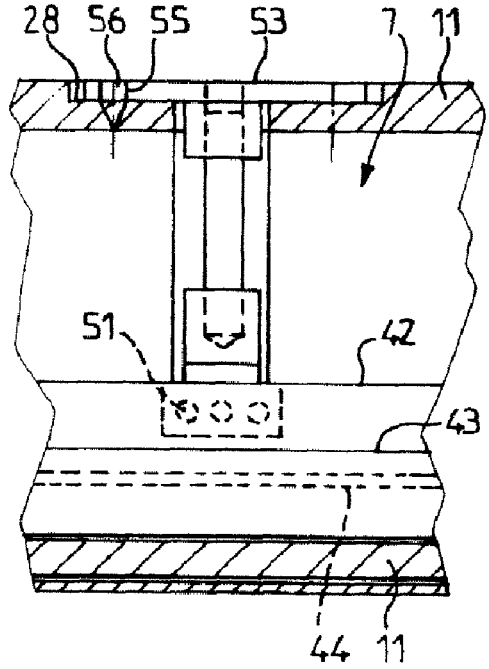

A description is now given of a general embodiment that is useful for understanding the invention, with reference to FIGS. 1 to 3. FIG. 1 shows a zone of the double hull of the ship, denoted by 1. The tank wall is composed, in succession, in its thickness, of a secondary insulating barrier 2 formed from caissons 3 juxtaposed on the double hull 1 and anchored to the latter by means of secondary retention members 4, then a secondary sealing barrier 5 carried by the caissons 3, then a primary insulating barrier 6 formed from juxtaposed caissons 7 anchored to the secondary sealing barrier 5 by primary retention members 48, and finally a primary sealing barrier 8 carried by the caissons 7.

The caissons 3 and 7 are parallelepipedal non-conducting elements with a mutually identical or different structure and mutually identical or different dimensions.

Secondary retention members 4 are fixed on pins 31 welded to the double hull 1 in a regular rectangular grid arrangement so that these retention members 4 can, on each occasion, hold four caissons 3, whose corners meet. Also provided are two secondary retention members 4 in the central zone of each caisson 3. However, depending on the size of the caisson, more or fewer than six anchoring points per caisson 3 may be necessary.

The secondary sealing barrier 5 is produced in accordance with the known technique in the form of a membrane consisting of Invar plate strakes 40 with raised edges. As may be seen better in FIG. 3, the cover panels 11 of the caissons 3 have longitudinal grooves, with an inverted-T-shaped cross section, denoted by 41. A weld support 42 in the form of a strip of Invar folded in the form of an L, is inserted slideably in each groove 41. Each plate strake 40 extends between two weld supports 42 and has two raised edges 43 welded, on each occasion, continuously by a weld bead 44 to the corresponding weld support 42, as may be seen in FIGS. 2 and 3. The primary sealing barrier 8 is produced in the same manner.

Similarly, the caissons 7 of the primary insulating barrier are anchored, on each occasion, to the four corners and at two points in the central zone of the caisson 7. To that end, use is made, on each occasion, of a primary retention member 48 shown in detail in FIGS. 2 and 3. The primary retention member 48 has a lower sleeve 49 integral with a lug 50 welded at several, for example three, points 51 of a weld support 42 above the raised edges 43 of the plate strakes 40. A rod 52 made from Permali, a composite material based on resin-impregnated beech wood, has a lower end fixed in the lower sleeve 49 and an upper end fixed in a sleeve 54 integral with a support washer 53 that bears on the cover panels 11 of the caissons 7, being accommodated in countersinks 28 at the corners of the caissons 7 and at the central shafts 30. The sleeve 54 is threaded and is screwed onto a corresponding threaded end of the rod 52. When the washer 53 has been thus positioned, immobilizing screws 56 are engaged through holes 55 provided in the washer 53 and screwed into the panel 11 in order thus to prevent any subsequent rotation of the washer 53. In each insulating barrier, the caissons 3 and 7 are juxtaposed with a small intermediate space of the order of 5 mm.

Advantageously, a layer of nanoporous materials of the aerogel type, which are very good thermal insulators, is included as insulation liner in the caissons 3 and/or 7. Aerogels also have the advantage of being hydrophobic, so absorption of the moisture from the boat into the insulating barriers is thus prevented. An insulation layer may be produced with aerogels, possibly pocketed, in textile form or in the form of beads.

Generally speaking, aerogels may be made from a number of materials, including silica, alumina, hafnium carbide and also varieties of polymers. Furthermore, in accordance with the manufacturing process, aerogels may be produced in powder, bead, monolithic sheet and reinforced flexible fabric form. Aerogels are generally manufactured by extracting or displacing the liquid of a gel of micronic structure. The gel is typically manufactured by means of chemical conversion and reaction of one or more dilute precursors. This results in a gel structure in which a solvent is present. Use is generally made of hypercritical fluids such as $CO_2$ or alcohol, to displace the gel solvent. Aerogels' properties may be modified by using a variety of doping and reinforcement agents.

The use of aerogels as insulation liners significantly reduces the thickness of the primary and secondary insulating barriers. It is, for example, possible to conceive of barriers 2 and 6 having a thickness of 200 mm and 100 mm, respectively, by using an aerogel bed in textile form in the caissons 3 and 7. The tank wall then has a total thickness of 310 mm. As a variant embodiment, it is possible to conceive of a tank wall having a total thickness of 400 mm by using, on each occasion, a layer of aerogel particles, particularly aerogel beads, in the caissons 3 and 7.

Figure 4:
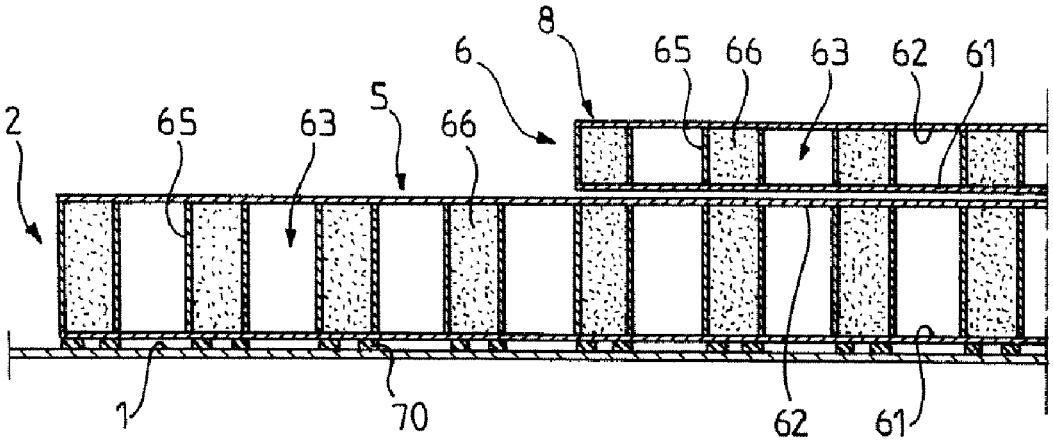
FIG. 4 is a transverse sectional view of a tank wall according to one embodiment of the invention.
Figure 5:
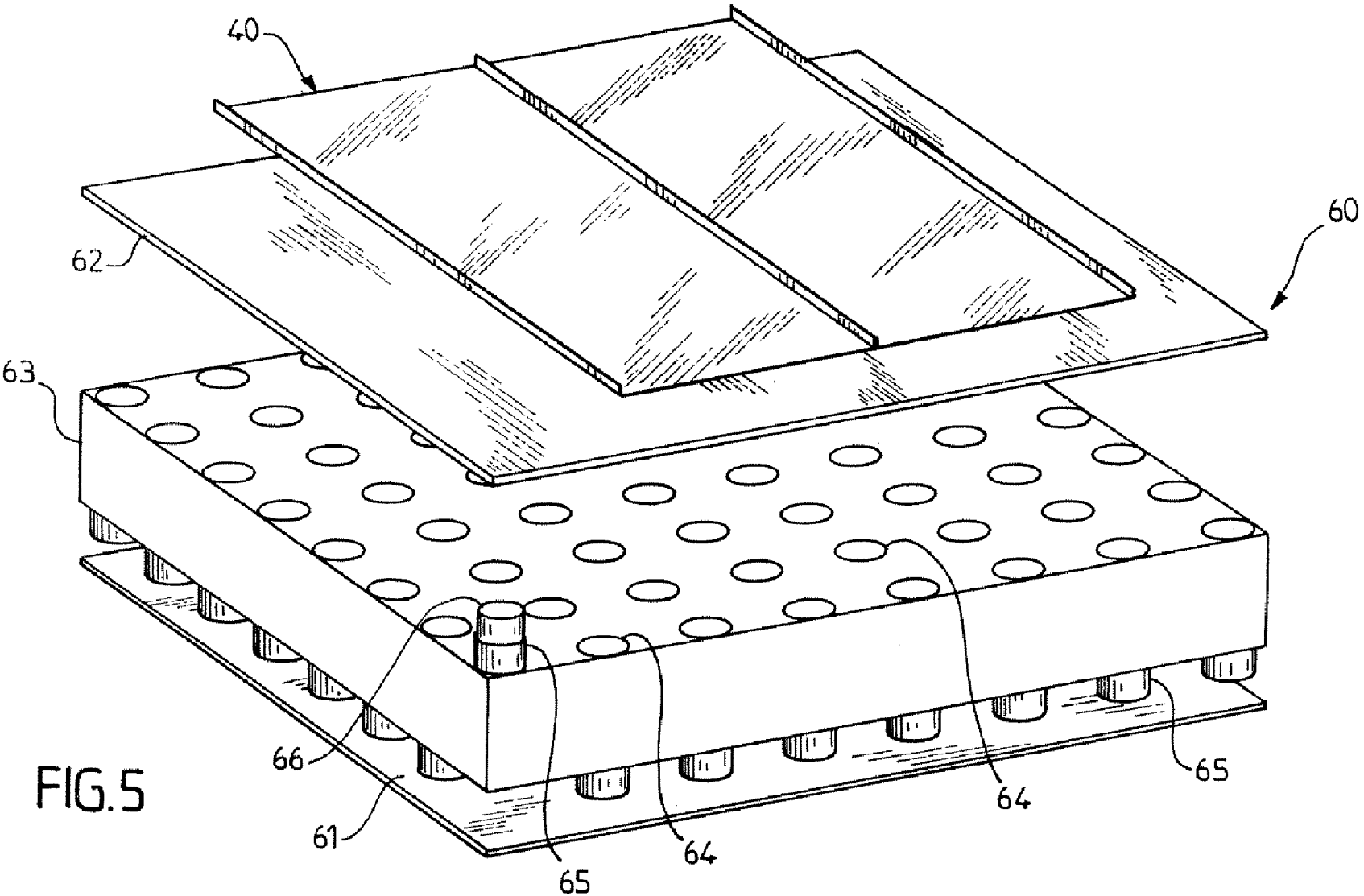
FIG. 5 is an expanded perspective view of a non-conducting element of the tank wall shown in FIG. 4.

With reference to FIGS. 4 and 5, a description will now be given of a first embodiment of a sealed, thermally insulated tank according to the invention. In the first embodiment, the primary and secondary insulating barriers are formed from non-conducting elements in the form of parallelepipedal caissons 60 whose structure is shown in FIG. 5 and that are arranged and anchored in a similar manner to the caissons 3 and 7 of FIG. 1, so a further description is unnecessary in this regard.

The caisson 60 includes a block of low-density synthetic foam 63, for example low-density polyurethane foam, optionally reinforced with fibers, sandwiched between a base panel 61 and a cover panel 62 that are fixed to its larger faces, for example by means of adhesive bonding.

Between the panels 61 and 62, load-bearing pillars 65 in the form of hollow tubes with a circular cross section extend in holes 64 provided in the thickness of the block 63. In the example shown, the pillars 65 are distributed in the form of a square-mesh grid, but other forms of distribution are possible. In the case of a non-conducting element with a 1.5-m-sided square cross section, provision is made, for example, for sixty-four pillars 65. However, the density of the pillars may be modified, particularly as a function of the forces to be taken up and of the cross section of the pillars. The inside of the pillars 65 is filled with insulation, which is, for example, the same foam as that forming the block 63 between the pillars 65, or another material, for example a material of higher density, in order to take up more compression forces.

In the embodiment of FIG. 5, the caisson 60 may be manufactured by means of the following steps: cutting a block of foam 63 from a bed of continuously-poured foam, machining holes 64 through the block 63, inserting pillars 65 in the holes 64, inserting plugs of insulation 66 in the pillars 65, and adhesive bonding of the panels 61 and 62.

Figure 6:
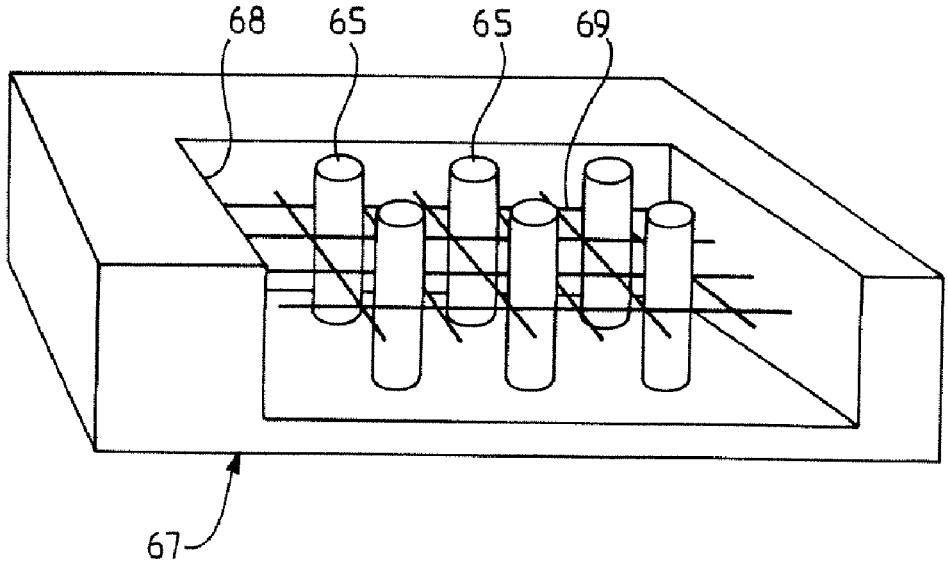
FIG. 6 is a perspective view of a molding step for obtaining a non-conducting element according to the first embodiment of the invention.

An alternate manufacturing method corresponds to FIG. 6, in which the block of foam is omitted. In such a case, pillars 65 are placed in the cavity 68 of a mold 67 and then foam is poured between the pillars 65 so as to obtain a block of foam in which the pillars 65 are embedded. The pillars 65 may also be filled during the same pouring step if their diameter is fairly large, for example greater than 100 mm. In order to guarantee the positioning and holding of the pillars 65 in the cavity of the mold, a planar positioning element is used, in this case in the form of a grid or of a glass mat 69, through which the pillars 65 are tightly fitted. The grid or glass mat 69 is also embedded in the thickness of the block of foam after molding, which makes it possible to reduce the expansion coefficient of the foam in this zone and thus to reduce the shear stresses between the panels 61 and 62 and the foam. Lastly, the panels 61 and 62 are adhesively bonded. Alternately, or in combination with this adhesive bonding, it is possible to fit the panels and the ends of pillars 65 together, which ends should, in such a case, extend beyond the block 63.

It would also be possible to commence by fixing the pillars 65 on the panel 61 and placing this assembly in the mold 67 in order to pour the foam directly over the panel 61, with or without the grid 69.

Figure 19:
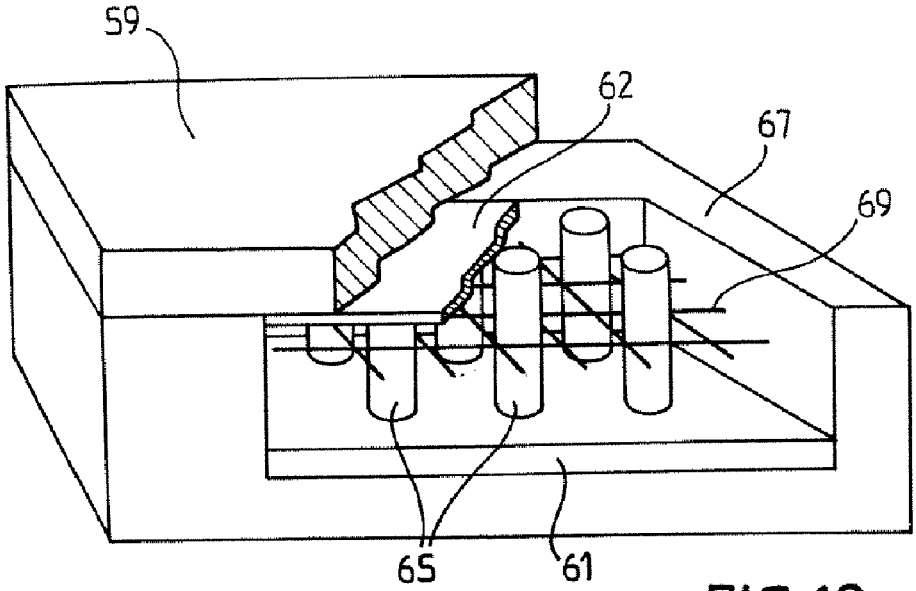
FIG. 19 is a view similar to FIG. 6, showing an alternate molding method.

FIG. 19 illustrates, using the same reference numerals as in FIG. 6, a further variant embodiment of the process in which the block of foam 63 is molded between the panels 61 and 62, which panels are placed with the pillars 65 (and, as appropriate, the grid or glass mat 69) in the mold 67, which is closed by a cover 59. This results in a caisson 60 that is finished in a single operation.

The pillars 65 may be manufactured in a number of materials. Plastics such as PVC, PC, PA, ABS, PU, PE and the like are particularly suited to the molding of pillars of any form and have an advantageous cost price. Other possible materials are composites, wood, plywood or synthetic foams. The panels 61 and 62 may be produced from plywood, plastic resin or a composite material. For example, their thicknesses are 6.5 mm for the base and 12 mm for the cover.

It will be noted that the caisson 60 may be manufactured, or, above all, easily cut out, in any form whatsoever in order to achieve precise connections when the tank is constructed or to take up tolerances. Indeed, it is easy to cut the panels 61 and 62 and the block 63 between the pillars 65 without compromising the cohesion and compression strength of each caisson part thus separated. As appropriate, it is also possible to cut hollow pillars 65 vertically.

The tank wall produced with the aid of the caissons 60 is shown in section in FIG. 4. In this example, thicker caissons are used for the secondary insulating barrier 2 than for the primary insulating barrier 6. The detail of the primary 4 and secondary 48 anchoring members and of the sealing barriers 5 and 8 is not shown. Reference may be made to FIGS. 1 to 3 in this regard.

As the geometry of the double hull 1 is irregular, provision is made for shims around the threaded pins 31. The thickness of each shim is calculated by computer on the basis of a topographical survey of the inner surface of the double hull 1. Thus, the base panels 61 of the secondary barrier 2 are positioned along a theoretical regular surface. Between the base panels 61 and the double hull 1, provision is conventionally made for beads of mastic 70 that are adhesively bonded to the base panels 61 and are crushed against the double hull when the caissons 60 are fitted, so as to provide their support. To avoid this mastic adhering to the double hull, a sheet of Kraft paper (not shown) is provided between them. Preferably, the beads 70 are placed in line with the pillars 65 in order to prevent flexing of the panel 61 on account of the compression force, which is transmitted predominantly in the region of the pillars 65. Furthermore, it would be possible to dispense with base panels and to rest the pillars 65 directly on the beads 70.

According to a variant embodiment (not shown), provision is made for peripheral walls extending to the periphery of the caisson 60 between the panels 61 and 62 so as to form a closed box capable of containing granular insulation. These walls may be fixed to the panels by means of adhesive bonding, stapling, flush-fitting and other fixing means. The caisson 60 may also be assembled in monobloc fashion, for example by means of blow-molding or rotational molding.

According to a further variant embodiment, the panels 61 and/or 62 are replaced by panel portions that cover only zones of the block 63 at the end of the pillars 65, not the entire surface of the block 63. The weld supports 42 will then be housed in the cover-panel portions.

Provision may be made for oblique pillars 65, i.e. pillars whose axis is not perpendicular to the base 61 and cover 62 panels. An inclination of this type makes it possible to take up not only shear forces but also overturning forces applied to the caisson 60.

With reference to FIGS. 7 to 12, a description is given of further embodiments of non-conducting caissons or elements that can be used to form the insulating barriers of the tank wall, the general structure of which was described for FIGS. 1 to 3. The production of the sealing barriers and the attachment of the various barriers is similar to the preceding embodiments, there will be no point in describing them again here.

Figure 9:
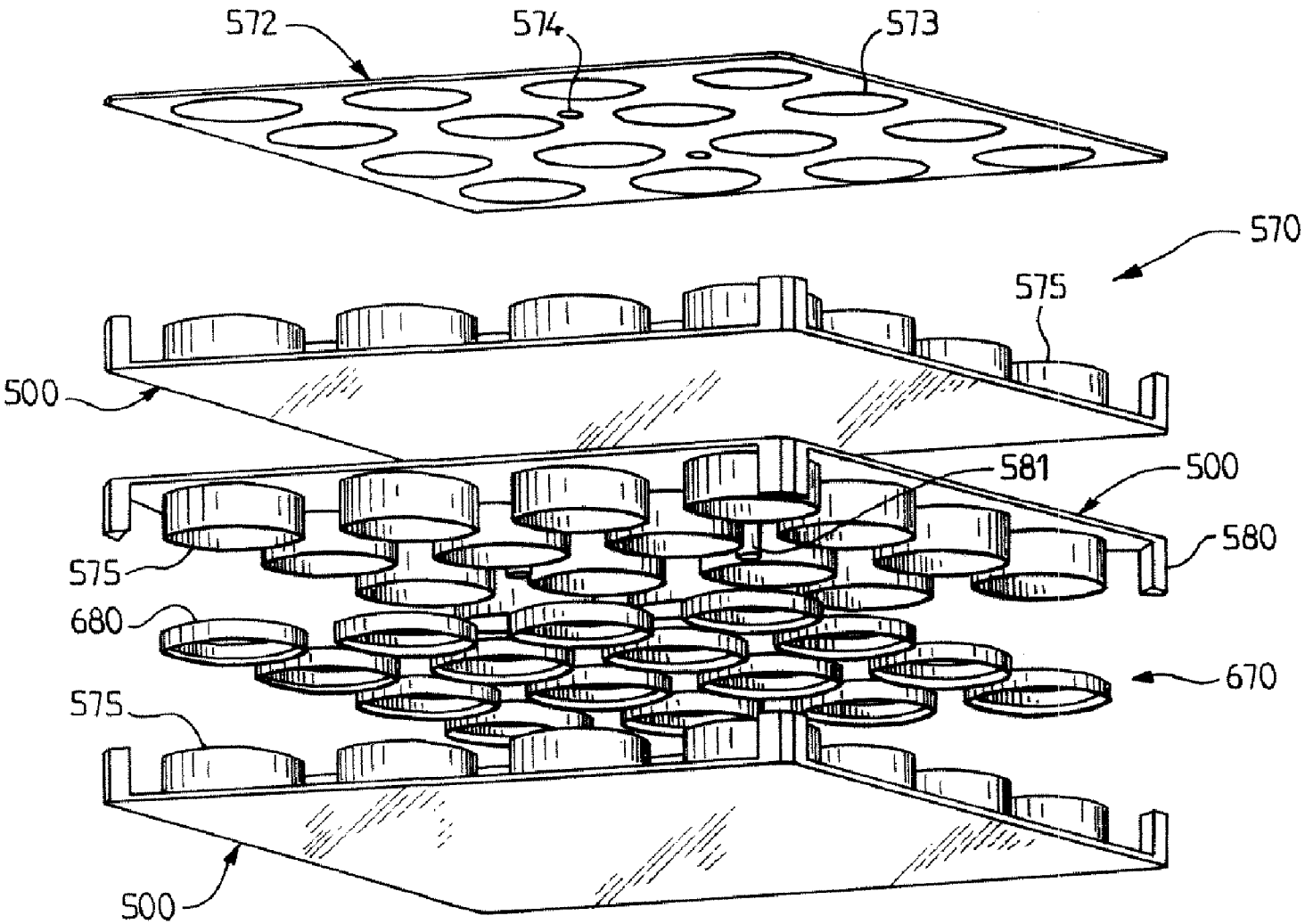
FIG. 9 is an expanded perspective view of two types of non-conducting element produced with the aid of the load-bearing structure of FIG. 7.

FIG. 9 shows, in expanded perspective view, a caisson 570 and a caisson 670 that are, respectively, manufactured with the aid of molded load-bearing structures 500, a description of which will now be given with reference to FIG. 7.

The load-bearing structure 500 is an injection-molded piece made from any appropriate material. It has a flat plate 571 with chamfered corners, for example in the form of a 1.5-m-sided square or of a rectangular, from one face of which sixteen hollow circular cylindrical pillars 575 project, arranged in the form of a regular square grid, plus two tubes 581 of smaller cross section in the region of a central zone of the plate, and also four triangular cylindrical pillars 580 in the region of the four corners of the plate. The plate 571 is continuous in the region of the base of the pillars 575 and 580, but pierced in the region of the base of the tubes 581 in order to allow the passage of a coupler rod. Furthermore, in the case of a caisson of the primary barrier 6, the plate 571 is slit in order to allow through the weld supports 42 and the raised edges 43 of plate strakes of the secondary sealing barrier. The pillars 580 serve to receive the bearing forces of the coupling members used at each corner of the non-conducting elements. The cross section of the pillars 575 is, for example, 300 mm for a 1.5 m square plate. As for the insulating liner, the load-bearing structure 500 may be covered with a layer of low-density foam, which is poured between and into the pillars 575.

The cross section of the pillars may be reasonably large, the important thing being to always make provision for several pillars per caisson. Thus, the dimensions of the pillars in terms of cross section may be ⅓ or even ½ of the corresponding dimensions of the caisson.

In order to form the caisson 570, an independent panel 572 with the same dimensions as the plate 571 is fixed on the end of the pillars 575 opposite this plate. This panel may be fixed by any means (adhesive bonding, stapling, flush fitting, etc.). In FIG. 9, provision has been made for circular grooves 573 on the inner face of the panel 572, for receiving the end of each pillar 575 tightly.

The materials of the structure 500 and of the panel 572 may be chosen so as to produce heat-shrinking of the pillars 575 in the panel. For example, with a piece 500 made from PVC and a panel 572 made from plywood, which exhibits less heat shrinkage, the end of the pillars 575 is made to grip the circular core delimited by the groove 573 when the tank is cooled. Conversely, gripping of the pillars 575 could also be obtained with a panel 572 that contracts more than the piece 500.

The panel 572 has holes 574 opposite the tubes 581 of the molded structure 500.

In the caisson 670, two identical molded structures 500 are arranged symmetrically and assembled together by causing their respective pillars 575 to bear against one another. This assembly may be produced by any means (adhesive bonding, welding, flush fitting, etc.). In FIG. 9, it is achieved with the aid of a linking ring 680 interposed, on each occasion, between two aligned pillars 575 and flush fitted over them. This assembly can be seen better in FIG. 10, where it will be observed that the linking ring 680 has an outer annulus 682 and an inner annulus 681 that are connected by means of a radial tongue 683. The pillars 575 flush fit between the two annuli 681 and 682 and abut on either side of the tongue 683. The material of the ring 680 may be chosen to have lower conductivity than that of the pillars 575, in order to fulfill a thermal insulation function. They may also, alternately or in combination, be chosen to have an expansion coefficient that is different from that of the pillars 575 in order to fulfill a thermal assembly function. In a variant embodiment, two molded structures having pillars with complementary cross sections may be fixed together by means of direct nesting of the pillars together.

The foam-filled piece 500 may also be used alone without a supplementary panel by rotating the plate 571 toward the inside of the tank in order to support the adjacent sealing barrier. The non-conducting element thus formed rests via the pillars 575 on the secondary sealing barrier or on the strips of resin fixed to the hull.

Figure 11:
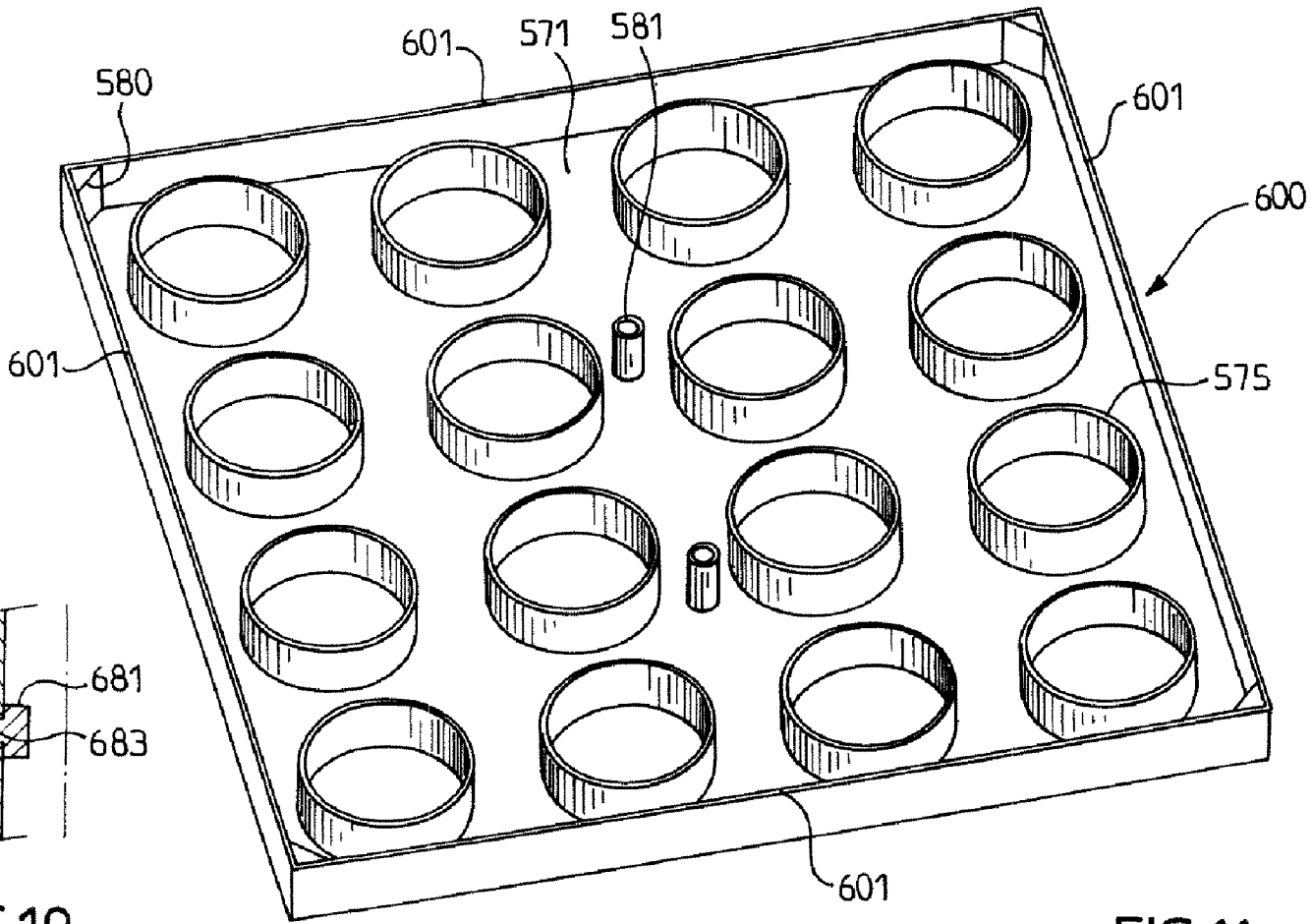
FIGS. 11 and 12 are views similar to FIG. 7, showing other variant embodiments of the load-bearing structure.
Figure 10:
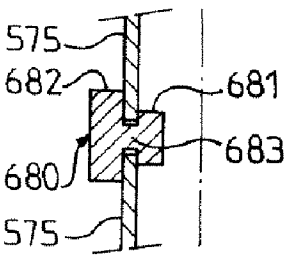
FIG. 10 is a partial, sectional view showing the assembly of a non-conducting element of FIG. 9.
Figure 12:
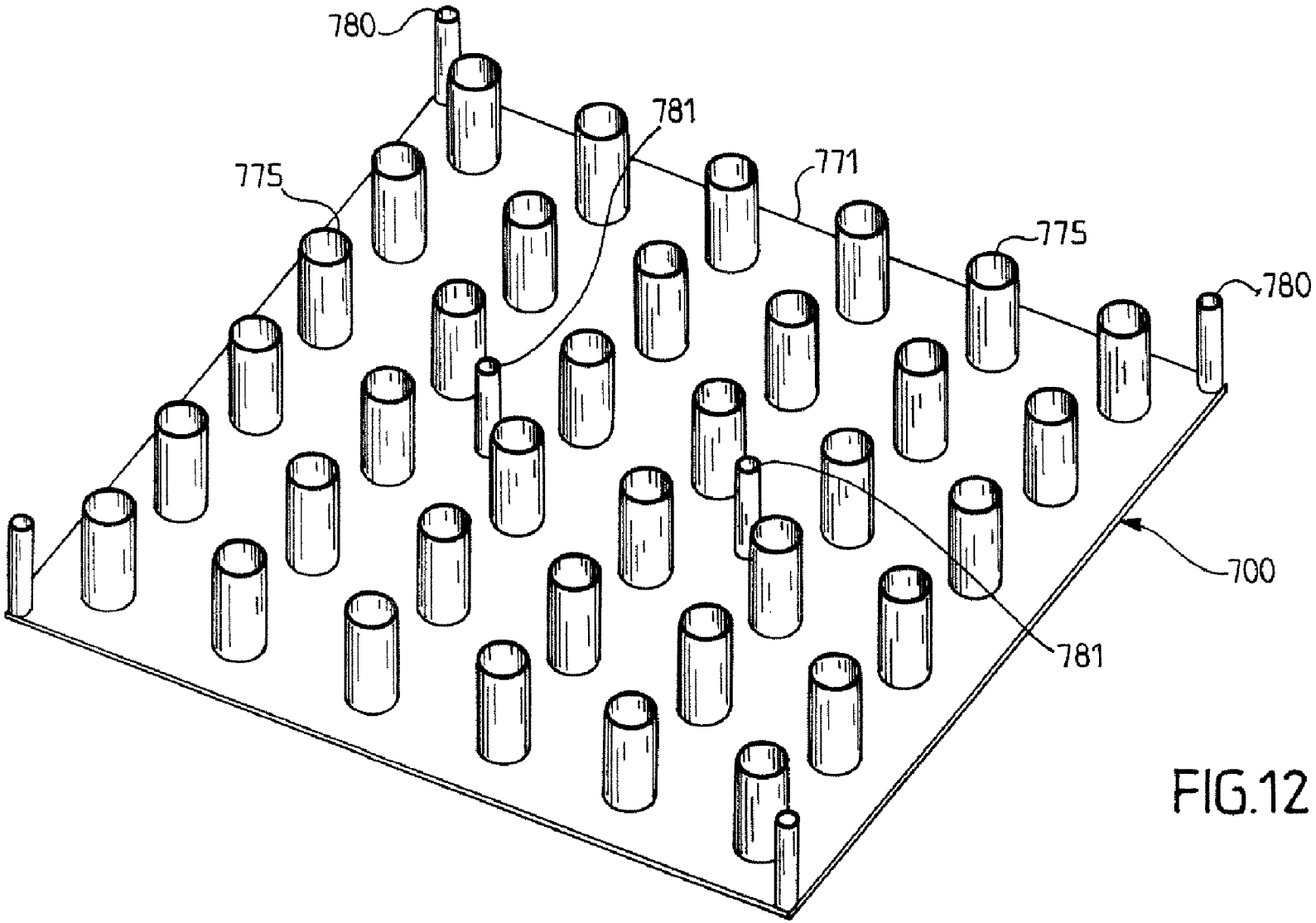

FIGS. 11 and 12 show molded load-bearing structures 600 and 700 that make it possible to produce non-conducting elements in a manner similar to the structure 500 described previously.

Figure 7:
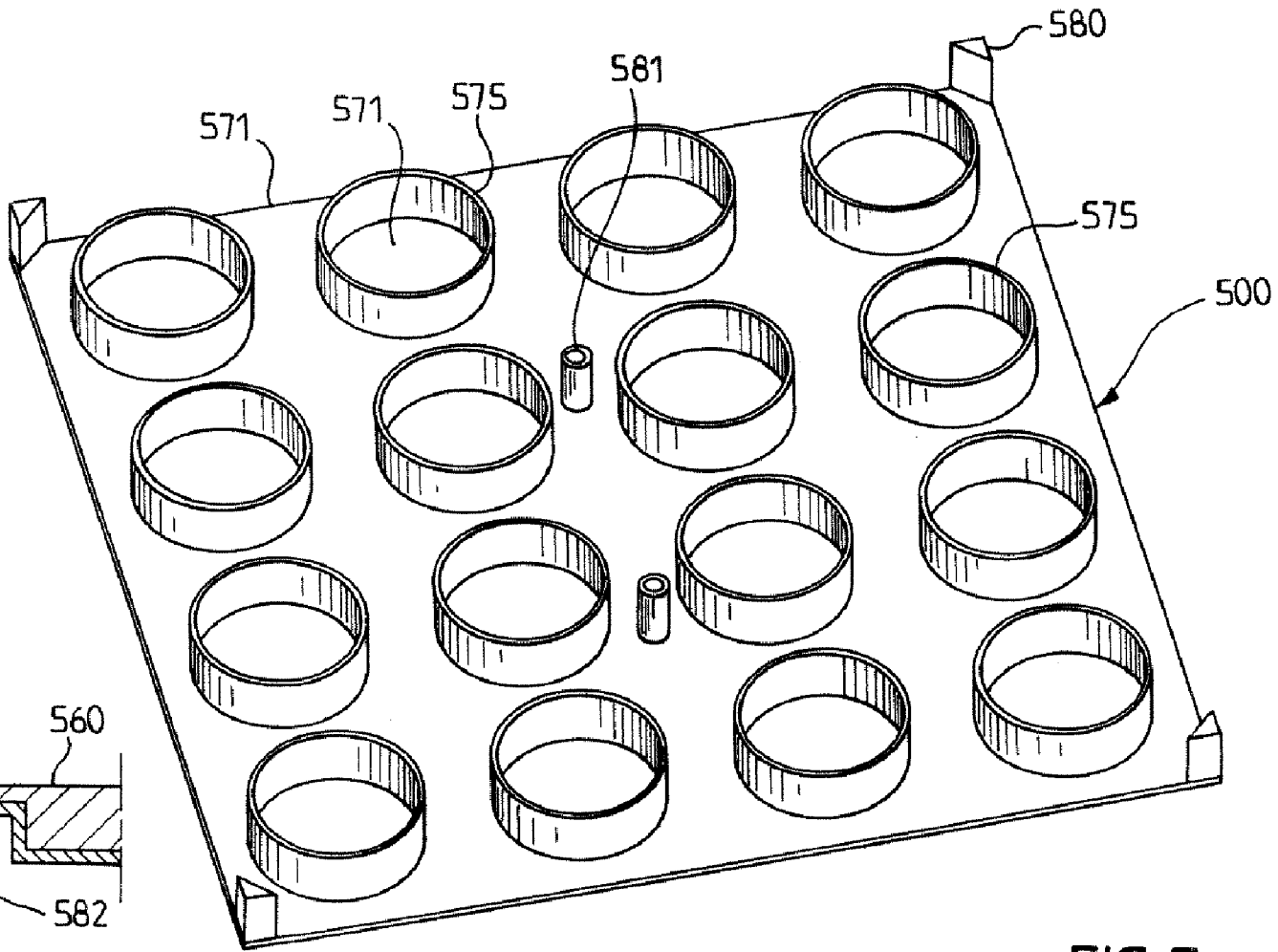
FIG. 7 shows, in perspective, a load-bearing structure molded as a single piece.

In FIG. 11, identical reference numerals to those in FIG. 7 denote identical elements. The structure 600 includes planar peripheral walls 601 extending continuously along the four edges of the plate 571, forming a box capable of containing insulation in the form of powder, beads or the like. For example, a structure 600 containing aerogel beads may be combined with a structure 600 containing low-density foam to form a caisson 670 as shown in FIG. 9.

In FIG. 12, the planar plate 771 carries thirty-six hollow tubular pillars 775 of smaller cross section (for example 100 mm) than the above-mentioned pillars 575, four hollow tubular pillars 780 with an even smaller cross section (for example 50 to 60 mm) in the region of its corners, and two tubular pillars 781, similar to the pillars 780, in the region of a central zone of the plate 771 in order to allow the coupling members serving to attach the insulating barrier to pass through.

Figure 8:
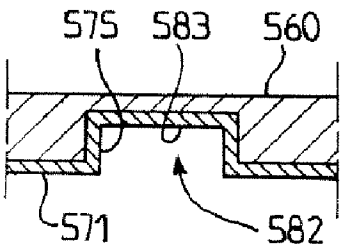
FIG. 8 is a partial sectional view showing a variant embodiment of the load-bearing structure of FIG. 7.

The structures 500, 600 and 700 may be injection-molded. A similar structure may also be obtained by thermoforming from a plastic plate. This possibility is illustrated in FIG. 8. In such a case, the initially planar plate 571 is heated and deformed to match the impression of a female mold 560. This results in load-bearing pillars 575 whose plate-side end is open and whose opposite end is closed by a wall 583. In such a case, the space 582 located inside the pillars 575 is filled with, for example, foam from the face of the plate 571 opposite these pillars.

The walls 601 may also obtained by thermoforming.

Figure 21:
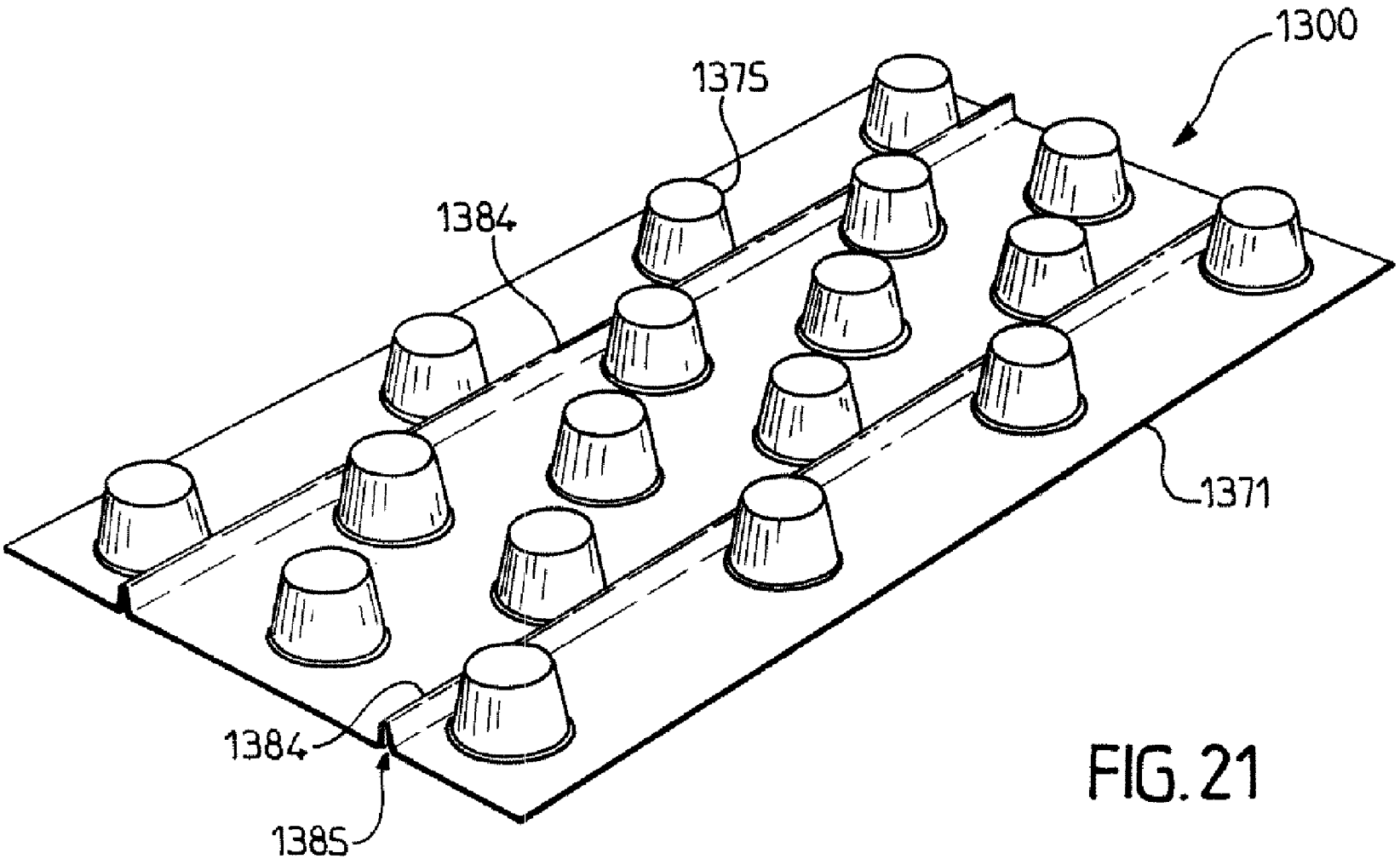
FIG. 21 shows, in perspective, a load-bearing structure thermoformed from a single piece.

FIG. 21 shows, in perspective, a thermoformed load-bearing structure 1300 that includes a plate 1371 that can act as base panel or cover panel for a caisson, and load-bearing pillars 1375 obtained in a similar way to the pillars 575 in FIG. 8. In the example shown, the pillars 1375 have a frusto-conical shape, which facilitates their forming. For example, provision may be made for a pillar diameter that varies from 160 mm at the base to 120 mm at the top, over a height of approximately 100 mm.

In order to serve as base panel of a caisson of the primary insulating barrier, the plate 1371 is provided with two longitudinal ribs 1384 extending over the entire length of the plate 1371. Each rib 1384 is obtained during the thermoforming operation by pushing the material in the same direction as the pillars 1375, so as to form a V-shaped fold that is open on the planar face of the plate 1371, the inner space 1385 of which allows the weld supports 42 and the raised edges 43 of the secondary sealing barrier to pass through. In the case of the secondary insulating barrier, the ribs 1384 are unnecessary.

A description was given previously of the load-bearing structures that include a plate acting as cover or base panel. A description is now given of a further embodiment of a non-conducting element 870 with reference to FIG. 13, in which the molded load-bearing structure 800 includes load-bearing elements 875 of small cross section connected by arms 890. This load-bearing structure is in plan view in FIG. 14. The load-bearing elements 875 are hollow circular cylindrical pillars arranged in a regular grid and connected by arms 890 that are arranged in the form of a square-mesh grid. A cover panel 872 and a base panel 871, for example made from plywood, plastic, composite or another material, are adhesively bonded on the two faces opposite the load-bearing structure 800. The arms 890 are located at the end of the load-bearing elements 875 adjacent to the panel 872 and have a planar upper face, which may serve for adhesive bonding of the panel 872.

Figure 20:
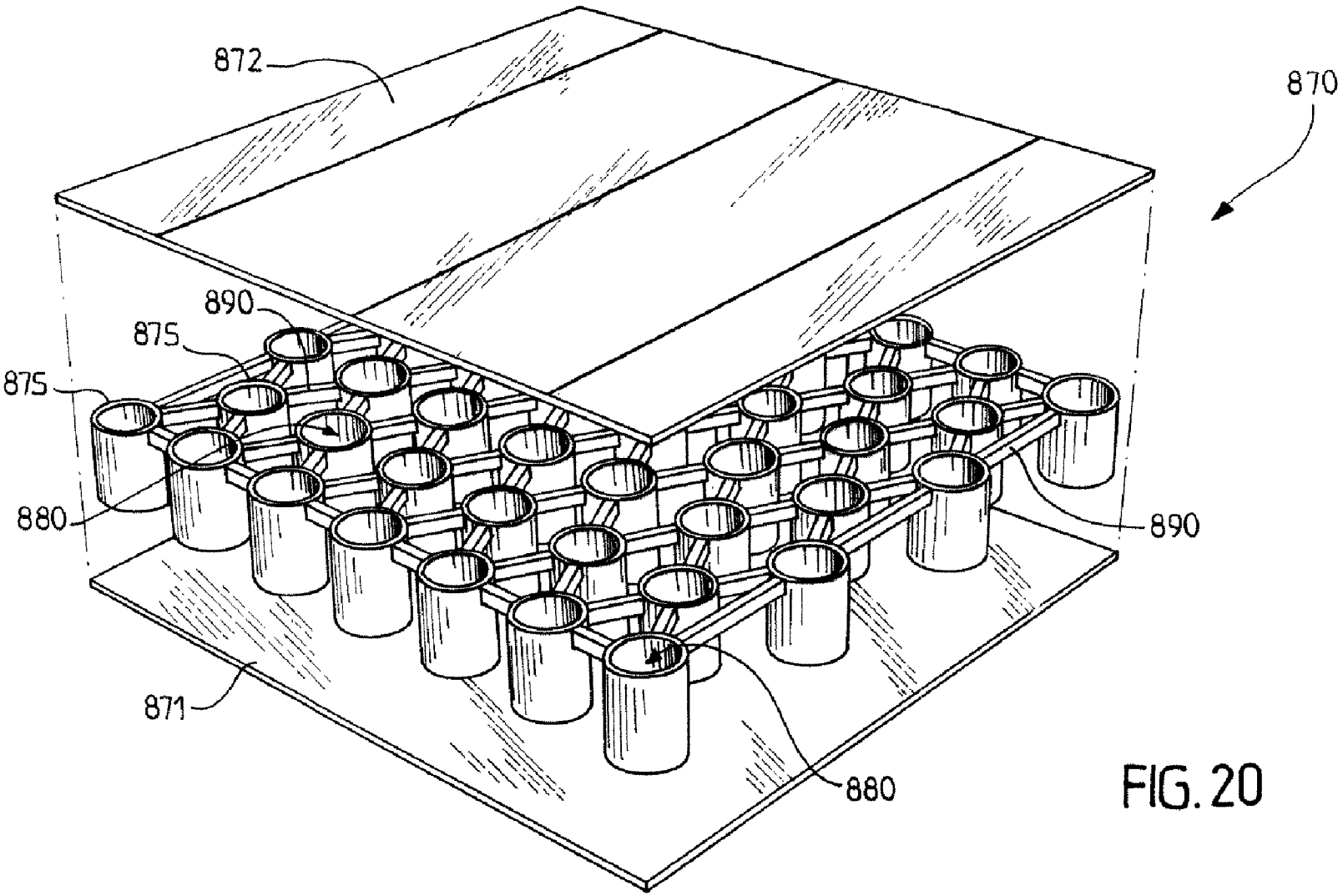
FIG. 20 is an expanded perspective view of a non-conducting element according to a further embodiment of the invention.

FIG. 20 shows the non-conducting element 870 in expanded perspective view, in a version that its slightly modified in terms of the arrangement of the linking arms 890.

Other arms may be provided in the region of the lower end of the pillars 875. The arms may also be placed in another region of the load-bearing pillars (for example half way up).

The inner space of the caisson 870, i.e. the inner space 880 of the pillars 875, and the space 876 between the pillars is filled with one or more types of insulation. When low-density foam is used, the caisson may be manufactured by placing a structure 800 of rectangular form in plan view in a mold, pouring the foam into the mold so as to embed the structure 800 in a parallelepipedal block of foam, then fixing the panels 872 and 871 to this block. The base panel 871 is not always necessary. One of the panels may also be molded as a single piece with the structure 800.

Although a description has been given of hollow load-bearing pillars of circular cross section in the caisson 60 and the load-bearing structures 500, 600, 700 and 800, the load-bearing pillars may have any other form in terms of cross section and any type of regular or irregular spatial distribution. For example FIG. 15 shows a load-bearing pillar 975 consisting of a plurality of concentric cylindrical walls 976. In the pillar 1075 of FIG. 16, the cylindrical walls 1076 have a square cross section.

FIG. 17 shows pillars 1175 distributed in lines in the form of a regular figure and with a hollow, square cross section with chamfered corners. In FIG. 18, pillars 1275, for example solid circular cylinders, are distributed in a staggered arrangement. Other cross sections are also achievable, i.e. rectangular, polygonal, I-shaped, solid or hollow, dihedral, etc. cross sections. The load-bearing pillars may also have a cross section that varies over their height, for example frustoconical pillars.

In all cases, such pillars may be molded so as to project from a plate and/or be linked by arms and/or by any linking means. When use is made of low-density foam as thermal insulation liner layer, it is particularly advantageous to pour this foam in a single step over the entire surface area of the linking plate, between and possibly into the load-bearing pillars. Another possibility is to machine wells in a block of foam formed in advance and to insert the load-bearing pillars into the wells formed for that purpose.

In the case of a granular insulation, it is necessary to use a non-conducting element with peripheral walls that are preferably formed as a single piece with the load-bearing structure, as in FIG. 11. By virtue of the form of the load-bearing elements of small cross section, the inner space of the box between them is not compartmentalized, and therefore the granular material is easier to distribute over the entire surface area of the non-conducting element. The granular material may also be inserted into hollow pillars.

Load-bearing pillars of very small cross section, for example smaller than 40 mm, may be left empty without detriment to the thermal insulation. Hollow pillars of small cross section may also be filled with a flexible-PE foam cone or with glass wool.

In the load-bearing structures 500, 600, 700 and 800 described previously, some pillars may also be replaced by partitions creating compartments inside the load-bearing structure.

Figure 22:
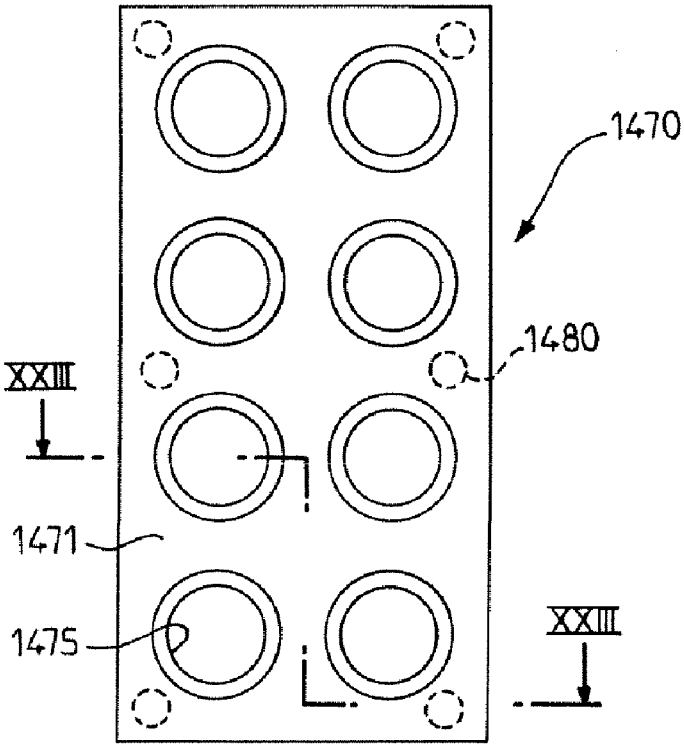
FIGS. 22 and 23 show in plan view and in sectional view on line XXIII a non-conducting element according to a further embodiment.
Figure 23:
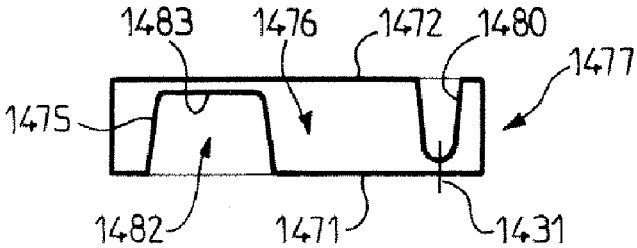

With reference to FIGS. 22 and 23, a description is now given of an embodiment of a non-conducting element that comprises a monobloc hollow caisson 1470 produced by rotational molding or by injection blow-molding. This caisson has the form of a closed hollow envelope 1477 that includes eight frustoconical pillars 1475 formed so as to project from the base wall 1471 of the envelope and each having a top wall 1483 capable of bearing against the top wall 1472 of the envelope in order to take up the compression forces.

To fix the caisson, six frustoconical shafts 1480 are provided, arranged at the periphery of the envelope and open through the top wall 1472. These shafts each have a base wall capable of bearing against the base wall 1471 in order take up the compression forces and capable of being pierced in order to receive a fixing rod, shown diagrammatically at 1431, which is, for example, a pin welded to the hull or a coupling device fixed to an underlying sealing barrier.

The inner space 1476 of the caisson and the inner space 1482 of the pillars 1475 may be filled with any suitable insulation, for example by injection of foam. Similarly, the shafts 1480 may be filled with insulation, for example PE foam or glass wool, after the caisson is fixed.

To mold the caisson 1470, use may be made, for example, of high-density PE, polycarbonate, PBT or another plastic. The shafts 1480 may also be dispensed with if use is made of another method of attaching the caissons, for example coupling members passing between the caissons to be attached and bearing on the top wall 1472 in the manner of the retention members 48 of FIGS. 2 and 3. Base and/or cover panels may also be fixed to the walls of the envelope in order to reinforce it.

Although a description has been given of essentially parallelepipedal, right-angled non-conducting elements, other forms of cross section are possible, notably any polygonal form capable of rendering a planar surface discrete.

Of course, the insulation liner of a non-conducting element may include an number of layers of material.

When one of the primary and secondary insulating barriers is produced with the aid of the non-conducting elements described above, it is possible, but not necessary, to produce the other insulating barrier in an identical manner. Non-conducting elements of two different types may be used in the two barriers. One of the barriers may consist of prior-art non-conducting elements.

The caissons of the secondary insulating barrier and of the primary insulating barrier may be anchored to the ship's hull in a different way from the example shown in the figures, for example with the aid of retention members engaged on the base panel of the caissons.

Although the invention has been described in connection with a number of particular embodiments, it is obviously not limited to these in any way and includes all technical equivalents of the means described and also combinations thereof if they fall within the scope of the invention.

What is claimed is:

1. Sealed, thermally insulated tank including at least one tank wall fixed to the hull of a floating structure, said tank wall having, in succession, in the direction of the thickness from the inside to the outside of said tank, a primary sealing barrier a primary insulating barrier, a secondary sealing barrier and a secondary insulating barrier, at least one of said insulating barriers consisting essentially of juxtaposed non-conducting elements, each non-conducting element including a thermal insulation liner arranged in the form of a layer parallel to said tank wall, and load-bearing elements that rise through the thickness of said thermal insulation liner in order to take up the compression forces, wherein the load-bearing elements of a non-conducting element include pillars of small transverse section as compared to the dimensions of the non-conducting element in a plane parallel to said tank wall, wherein said non-conducting element has the form of a monobloc hollow closed box with a base panel, a cover panel, and peripheral walls extending between said panels along edges of said panels, said pillars comprising frustoconical pillars formed so as to project from the base panel and each having a top wall capable of bearing against said cover panel in order to take up the compression forces, the monobloc defining a monobloc closed envelope filled with insulating material.

2. Sealed, thermally insulated tank according to claim 1, wherein said box has frustoconical shafts arranged at the periphery of said box and open through said cover panel, each shaft having a base wall arranged to bear against said base panel in order to take up compression forces and capable of being pierced in order to receive a fixing rod.

3. Sealed, thermally insulated tank according to claim 1, characterized in that said pillars are identically spaced apart in the length direction and in the width direction of the non-conducting element.

4. Sealed, thermally insulated tank according to claim 3, wherein said box has frustoconical shafts arranged at the periphery of said box and open through said cover panel, each shaft having a base wall arranged to bear against said base panel in order to take up compression forces and capable of being pierced in order to receive a fixing rod.

5. Sealed, thermally insulated tank according to claim 1, characterized in that said pillars are produced from plastic or a composite.

6. Sealed, thermally insulated tank according to claim 5, wherein said box has frustoconical shafts arranged at the periphery of said box and open through said cover panel, each shaft having a base wall arranged to bear against said base panel in order to take up compression forces and capable of being pierced in order to receive a fixing rod.

7. Floating structure, characterized in that it comprises a sealed, thermally insulated tank according to claim 1.

8. Floating structure according to claim 7, characterized in that it consists of a methane carrier.

9. Sealed, thermally insulated tank according to claim 1, characterized in that said pillars are regularly distributed over the entire surface of the non-conducting element seen in a plane parallel to the tank wall.

10. Sealed, thermally insulated tank according to claim 9, characterized in that said pillars are identically spaced apart in the length direction and in the width direction of the non-conducting element.

11. Sealed, thermally insulated tank according to claim 9, wherein said box has frustoconical shafts arranged at the periphery of said box and open through said cover panel, each shaft having a base wall arranged to bear against said base panel in order to take up compression forces and capable of being pierced in order to receive a fixing rod.

12. Sealed, thermally insulated tank according to claim 1, characterized in that said pillars have a closed hollow transverse section.

13. Sealed, thermally insulated tank according to claim 12, wherein said box has frustoconical shafts arranged at the periphery of said box and open through said cover panel, each shaft having a base wall arranged to bear against said base panel in order to take up compression forces and capable of being pierced in order to receive a fixing rod.

14. Sealed, thermally insulated tank according to claim 12, characterized in that said pillars are tubes of circular cross section.

15. Sealed, thermally insulated tank according to claim 14, wherein said box has frustoconical shafts arranged at the periphery of said box and open through said cover panel, each shaft having a base wall arranged to bear against said base panel in order to take up compression forces and capable of being pierced in order to receive a fixing rod.

16. Sealed, thermally insulated tank according to claim 1, characterized in that said insulation liner of the non-conducting element includes a block of synthetic foam (63).

17. Sealed, thermally insulated tank according to claim 16, wherein said box has frustoconical shafts arranged at the periphery of said box and open through said cover panel, each shaft having a base wall arranged to bear against said base panel in order to take up compression forces and capable of being pierced in order to receive a fixing rod.

18. Sealed, thermally insulated tank according to claim 16, characterized in that said block of synthetic foam is obtained by pouring between said pillars so as to embed at least one height portion of said pillars in said block of synthetic foam.

19. Sealed, thermally insulated tank according to claim 18, wherein said box has frustoconical shafts arranged at the periphery of said box and open through said cover panel, each shaft having a base wall arranged to bear against said base panel in order to take up compression forces and capable of being pierced in order to receive a fixing rod.

* * * * *